US009305690B2

(12) United States Patent
Choto et al.

(10) Patent No.: US 9,305,690 B2
(45) Date of Patent: Apr. 5, 2016

(54) COMPOSITE FERRITE COMPOSITION AND ELECTRONIC DEVICE

(71) Applicant: TDK CORPORATION, Tokyo (JP)

(72) Inventors: Hiroki Choto, Tokyo (JP); Takashi Suzuki, Tokyo (JP); Shinichi Kondo, Tokyo (JP); Yuya Oshima, Tokyo (JP); Masahiro Endo, Tokyo (JP); Masaki Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 14/266,214

(22) Filed: Apr. 30, 2014

(65) Prior Publication Data

US 2014/0333405 A1 Nov. 13, 2014

(30) Foreign Application Priority Data

May 10, 2013 (JP) ..... 2013-100601

(51) Int. Cl.

| | |
|---|---|
| ***H01F 5/00*** | (2006.01) |
| ***H01F 27/28*** | (2006.01) |
| ***H01F 1/40*** | (2006.01) |
| ***H01F 1/37*** | (2006.01) |
| ***H01F 17/00*** | (2006.01) |

(52) U.S. Cl.

CPC ..... *H01F 1/401* (2013.01); *H01F 1/37* (2013.01); *H01F 17/0013* (2013.01)

(58) Field of Classification Search

CPC ..... H01F 1/37

USPC ..... 339/200; 336/200

See application file for complete search history.

(56) References Cited

U.S. PATENT DOCUMENTS

| | | | | |
|---|---|---|---|---|
| 8,102,223 | B2 | 1/2012 | Umemoto et al. | |
| 2010/0259352 | A1* | 10/2010 | Yan et al. | 336/200 |
| 2013/0093557 | A1 | 4/2013 | Odahara | |
| 2013/0154786 | A1* | 6/2013 | Nakajima et al. | 336/200 |
| 2014/0145816 | A1* | 5/2014 | Sato et al. | 336/208 |

FOREIGN PATENT DOCUMENTS

| | | | |
|---|---|---|---|
| JP | H03-136307 | A | 6/1991 |
| JP | A-05-036531 | | 2/1993 |
| JP | H06-077022 | A | 3/1994 |
| JP | A-11-026241 | | 1/1999 |
| JP | H11-273979 | A | 10/1999 |
| JP | A-2002-100510 | | 4/2002 |
| JP | A-2002-175916 | | 6/2002 |
| JP | A-2004-297020 | | 10/2004 |
| JP | 2009298684 | A | 12/2009 |
| KR | 2013-0040721 | A | 4/2013 |

* cited by examiner

*Primary Examiner* — Elvin G Enad
*Assistant Examiner* — Ronald Hinson
(74) *Attorney, Agent, or Firm* — Oliff PLC

(57) ABSTRACT

A composite ferrite composition comprises a magnetic material and a non-magnetic material. A mixing ratio of said magnetic material and said non-magnetic material is 20 wt %:80 wt % to 80 wt %:20 wt %. Ni—Cu—Zn based ferrite is used as the magnetic material. Oxides of Zn, Cu, and Si are at least included in a main component of said non-magnetic material. Borosilicate glass is included in a subcomponent of said non-magnetic material.

6 Claims, 3 Drawing Sheets

COMPOSITE FERRITE COMPOSITION AND ELECTRONIC DEVICE

BACKGROUND OF THE INVENTION

1. Field of the Invention

The present invention relates to a composite ferrite composition exhibiting excellent high frequency property and further relates to an electronic device employing the same.

2. Description of the Related Art

Recently, a higher frequency band is used for mobile phones, PC and the like, and several GHz standards already exist. In line with that, noise reduction products applicable to the above high frequency signals are demanded. As a representative example, a multilayer chip coil is exemplified.

Electric properties of the multilayer chip coil can be evaluated by analyzing impedance data. The impedance characteristics are significantly influenced by permeability of element body materials and also its frequency properties up to 100 MHz. Further, the impedance in GHz band is influenced by stray capacitance between facing electrodes of the multilayer chip coil. As a method for reducing the stray capacitance between the facing electrodes of the multilayer chip coil, extension of a distance between the facing electrodes, area reduction of the facing electrodes, and decrease of dielectric constant between the facing electrodes are exemplified.

For Patent Document 1 described below, in order to reduce the stray capacitance, terminals are formed at both ends in a direction of magnetic flux, which is generated due to energization of a coil. In the invention of Patent Document 1, it enables to extend a distance between an internal electrode and a terminal electrode and also enables a reduction of the facing area between the internal electrode and the terminal electrode. With this, it is expected that the frequency properties can be improved up to higher frequencies.

However, in the invention of Patent Document 1, the stray capacitance between internal electrodes is not reduced and there is room for further improvement for this matter. Further, it is an improvement method to change the structure by extending a distance between internal electrodes and also reducing the area of the internal electrodes, and this brings about a significant influence on other properties, size and shape. The extension of the distance between internal electrodes influences the size of products and therefore it is difficult to apply the invention of Patent Document 1 to chip parts that miniaturization is demanded. Further, for the area reduction of internal electrodes, there is a problem that the DC resistance increases.

Currently, as element body materials for a multilayer chip coil, it is often the case that Ni—Cu—Zn based ferrite is used. In order for co-firing with Ag which is used as an internal electrode, Ni—Cu—Zn based ferrite is selected since it is magnetic ceramics capable of firing at 900° C. temperature. The dielectric constant of Ni—Cu—Zn based ferrite is approximately 14 to 15, and it is said that there is room for further reduction. However, it is difficult to reduce the dielectric constant of Ni—Cu—Zn based ferrite and some sort of improvement approach is necessary.

Further, for Patent Document 2 described below, Ni—Cu—Zn based ferrite and low dielectric constant non-magnetic material are mixed and composite materials thereby obtained are used as element body materials. As for the low dielectric constant non-magnetic materials, silica glass, borosilicate glass, steatite, alumina, forsterite, and zircon are exemplified.

In the invention of Patent Document 2, by mixing ferrite with low dielectric constant non-magnetic material, the dielectric constant is reduced. Further, in the invention of Patent Document 3, the application of foamed ferrite is indicated. Specifically, in Patent Document 3, burned-out materials are mixed in the magnetic ceramics and fired to form holes, and resin or glass is impregnated therein. By providing holes, the low dielectric constant can be achieved. Further, by impregnating the hole with resin or glass, it enables to cover the demerit of the foamed ferrite that the strength gets weaken.

However, for Patent Document 2, when glass-based materials are determined as a main component, the decrease of the permeability μ becomes prominent. It is considered that this is caused by an inhabitation of grain growth of magnetic materials and a division of magnetic path. Further, a reaction between ferrite and glass remarkably appears. With this, a heterophase is formed and thereby insulation resistance deteriorates. Therefore, for the glass-based materials, when co-firing with Ag-based conductor, there is a high possibility of short circuit, so that it is not suitable as a multilayer coil employing Ag-based conductor.

On the other hand, for ceramic materials such as steatite, alumina, forsterite, and zircon, it is considered that deterioration of insulation resistance is small. However, there is a problem with sinterability and it is considered difficult to sinter composite materials at a firing temperature 900° C., which is capable of co-firing with internal electrodes Ag.

Further, for the invention of Patent Document 3, there are no problems with properties and sinterability. However, a number of holes are included in ferrite and terminal electrodes cannot directly be attached. Therefore, for example, it is necessary to use ferrite having less holes on the portion where terminal electrodes are formed, so that the structure becomes complicated. Further, a particle diameter of ferrite having a number of holes after firing gets smaller compared to that of ferrite having less holes. Therefore, humidity resistance and the like tend to deteriorate.

In view of the above, for a method of combining magnetic materials with low dielectric constant non-magnetic materials, there needs to be improvements for the following five problems. Specifically, decrease of sinterability, decrease of permeability μ, lower frequency of frequency property of permeability μ, smaller effects of decreasing of dielectric constant, and deterioration of insulation resistance. It is considered difficult to provide a multilayer coil having high impedance in GHz band and also simultaneously to resolve the above problems.

Patent Document 1: Japanese Published Unexamined Application No. H11-026241

Patent Document 2: Japanese Published Unexamined Application No. 2002-175916

Patent Document 3: Japanese Published Unexamined Application No. 2004-297020

SUMMARY OF THE INVENTION

It is therefore an object of the present invention to provide a composite ferrite composition exhibiting excellent sinterability, high permeability, high insulation resistance, low-dielectric constant, and excellent frequency property, and also to provide an electronic device employing the same.

In order to achieve the object of the invention, there is provided a composite ferrite composition comprising:

a magnetic material and a non-magnetic material, wherein a mixing ratio of said magnetic material and said non-magnetic material is 20 wt %:80 wt % to 80 wt %:20 wt %, said magnetic material is Ni—Cu—Zn based ferrite, at least oxides of Zn, Cu, and Si are included in a main component of said non-magnetic material, and borosilicate glass is included in a subcomponent of said non-magnetic material.

For the composite ferrite composition according to the present invention, Ni—Cu—Zn based ferrite is used and therefore the sinterability is excellent relatively at low temperature. Further, in this invention, by including a predetermined non-magnetic material at a predetermined ratio with respect to the Ni—Cu—Zn based ferrite, it enables to achieve a composite ferrite composition exhibiting excellent sinterability, high permeability, high insulation resistance, low dielectric constant, and excellent frequency property, which is discovered by the present inventors.

Specifically, according to this invention, by including the non-magnetic materials having low fluidity at a predetermined ratio with respect to the Ni—Cu—Zn based ferrite, it is considered that it enables to reduce a magnetic domain wall displacement area of the Ni—Cu—Zn based ferrite and also enables to reduce a division of magnetic path. Further, as non-magnetic materials, by choosing non-magnetic ceramic materials that comprise ceramic materials having a composition mainly composed of Zn oxide among ceramic materials having low fluidity, it enables to reduce influences of mutual diffusion of elements. The non-magnetic materials include a lot of Zn which are also included in the Ni—Cu—Zn based ferrite, so that it is considered that the mutual diffusion of elements between two materials decreases. Further, even if the mutual diffusion of elements is generated, it causes a slight change in the amount of elements which are originally included, and it brings about small influences on the properties.

Further, by arbitrarily changing the composition of Ni—Cu—Zn based ferrite as the magnetic material, the composition of the non-magnetic material, and a mixing ratio of the magnetic material and the non-magnetic material, there is an advantage that permeability (20 to 1.4) and dielectric constant (11 to 7) can be adjusted.

Preferably, the main component of the non-magnetic material is expressed by a general formula "a(bZnO.cMgO.dCuO).SiO2", and a, b, c and d in the general formula satisfies the following: a=1.5 to 2.4, b=0.2 to 0.98, c=1.00−b−d, and d=0.02 to 0.15.

Preferably, the non-magnetic material includes 0.5 to 17.0 wt % of Mo—$SiO_2$—$B_2O_3$ glass (MO denotes alkaline earth metal oxides) as a subcomponent.

By adding the Mo—$SiO_2$—$B_2O_3$ based glass at predetermined weight as the non-magnetic material, sinterability of whole composite materials is improved and both high permeability and insulation resistance can be achieved, so that it enables to apply in a multilayer coil component.

An electronic device according to the present invention comprises a coil conductor and a ceramic layer laminated, wherein said coil conductor includes Ag, and said ceramic layer is composed of the above mentioned composite ferrite composition.

DESCRIPTION OF THE PREFERRED EMBODIMENTS

The followings are the explanation of the present invention based on embodiments illustrated in FIGS.

Figure 1:
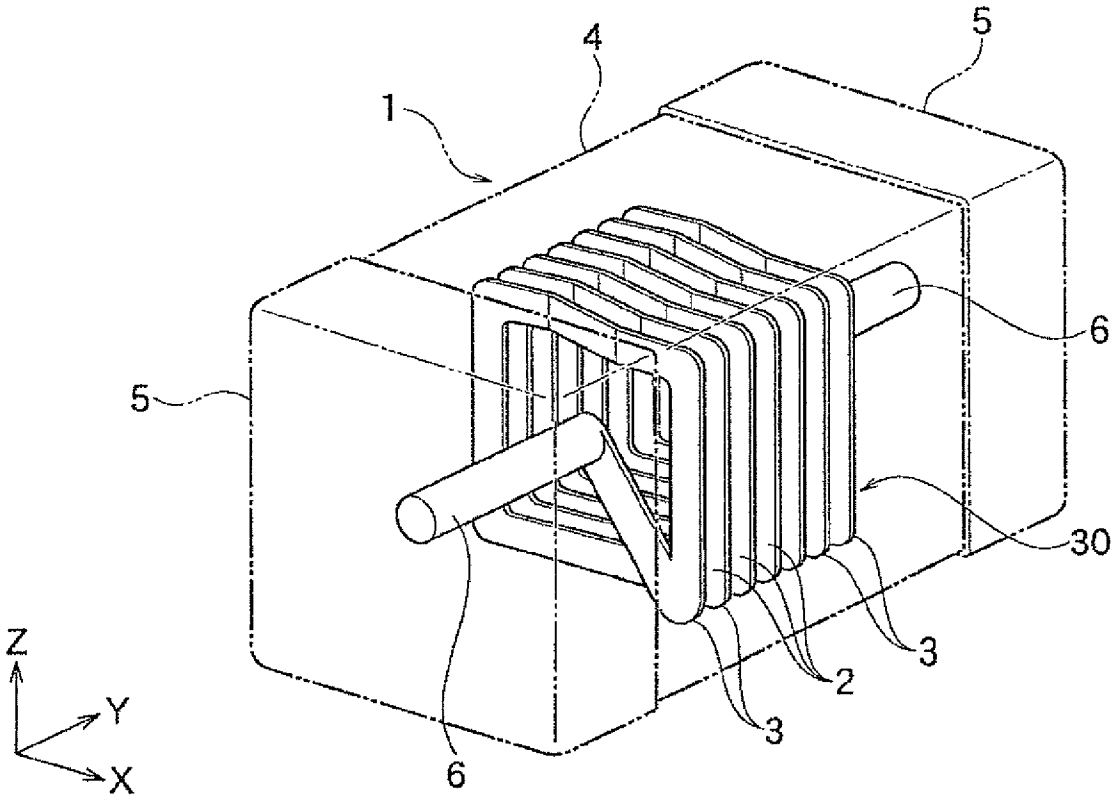
FIG. 1 is an internal schematic perspective view of a multilayer chip coil as an electronic device according to one embodiment.

As illustrated in FIG. 1, a multilayer chip coil 1 as an electronic device according to one embodiment of the present invention has a chip body 4 wherein ceramic layers 2 and internal electrode layers 3 are alternately laminated in the Y-axis direction.

Each of internal electrode layers 3 has a rectangular annular shape, C shape, or U shape and they are spirally connected by through-hole electrodes (not shown in FIGS) for connecting internal electrodes that penetrates adjacent ceramic layers 2 or stepped electrodes to form a coil conductor 30.

At both ends of the Y-axis direction of the chip body 4, terminal electrodes 5, 5 are respectively formed. At each terminal electrode 5, ends of through-hole electrode 6 for connecting terminals that penetrates laminated ceramic layers 2 are connected, and each terminal electrodes 5,5 are connected to both ends of the coil conductor 30 forming a closed magnetic circuit coil (winding pattern).

In the present embodiment, a laminating direction of the ceramic layer 2 and the internal electrodes layer 3 corresponds to the Y-axis, and end surfaces of the terminal electrodes 5, 5 are parallel to the X-axis and Z-axis. For the X-axis, Y-axis and Z-axis, they are perpendicular to one another. In the multilayer chip coil 1 illustrated in FIG. 1, a winding axis of the coil conductor 30 approximately corresponds to the Y-axis.

There no particular limitations in outer shape and measurement of the chip body 4, and they may be appropriately determined for the purpose. Generally, the outer shape is determined as parallelepiped shape, specifically for example, the x-axis measurement is 0.15 to 0.8 mm, the Y-axis measurement is 0.3 to 1.6 mm, and the z-axis measurement is 0.1 to 1.0 mm.

Further, a thickness between electrodes of the ceramic layer 2 and a thickness of the base are not particularly limited. Specifically, the thickness between electrodes (a space between internal electrode layers 3, 3) can be determined as approximately 3 to 50 μm, and the thickness of the base (a length of Y-axis direction of the through-hole electrode 6 for connecting terminals) can be determined as approximately 5 to 300 μm.

In the present embodiment, the terminal electrode 5 is not particularly limited, and it is formed by applying conductive paste including Ag and Pd as main components on the outer surface of the chip body 4 and then burning, and further applying electroplating. For the electroplating, Cu, Ni, Sn and the like may be used.

The coil conductor 30 includes Ag (including alloys of Ag), and specifically, for example, it is formed by Ag alone, Ag—Pd alloy and the like. As subcomponents of the coil conductor, Zr, Fe, Mn, Ti and oxides thereof may be included.

The ceramic layer 2 is composed of the composite ferrite composition according to one embodiment of the present invention. The following is the detailed explanation of the composite ferrite composition.

The composite ferrite composition of the present embodiment includes magnetic materials and non-magnetic materials. For the mixing ratio of the magnetic materials and the non-magnetic materials, it is 20 wt %:80 wt % to 80 wt %:20 wt %, preferably 40 wt %:60 wt % to 60 wt %:40 wt %. The dielectric constant is increased when the ratio of the magnetic materials is too high, and thereby high frequency property deteriorates since high impedance cannot be obtained in the GHz bands. Further, the permeability deteriorates when the ratio of the magnetic materials is too low, and thereby the impedance becomes lower in the range of 100 MHz to GHz bands.

As for the magnetic materials, Ni—Cu—Zn based ferrite is used. For the Ni—Cu—Zn based ferrite, it is not particularly limited and various compositions may be appropriately selected for the purpose. However, it is preferable to use the ferrite composition including 40 to 50 mol %, preferably 45 to 50 mol % of $Fe_2O_3$, 4 to 50 mol %, preferably 10 to 40 mol % of NiO, 4 to 20 mol %, preferably 6 to 13 mol % of CuO, and 0 to 40 mol %, preferably 1 to 30 mol % of ZnO in terms of mol % in the ferrite sintered body after firing. Further, Co oxide may be included in the range of 10 wt % or less.

The magnetic properties of the magnetic ferrite have a strong composition dependency. In the region where the composition of $Fe_2O_3$, NiO, CuO and ZnO is beyond the range described above, the permeability and quality factor Q tends to deteriorate. Specifically, for example, the permeability decreases when the amount of $Fe_2O_3$ is too small, the permeability increases as each composition get closer to the stoichiometric composition, and the permeability sharply decreases around the stoichiometric composition. Further, as the amount of NiO decreases or the amount of ZnO increases, the permeability increases. However, as the amount of ZnO increases, the Curie temperature falls below 100° C. With this, it becomes difficult to satisfy the temperature property required for electronic devices. Further, when the amount of CuO decreases, the low-temperature firing (below 930° C.) becomes difficult. On the contrary, when the amount of CuO increases, the quality factor Q deteriorates with a decrease of electrical resistivity of ferrite.

The average particle size is within the range of 0.1 to 1.0 μm. When the average particle diameter is too small, a specific surface area of ferrite powder gets larger and it becomes very difficult to make coatings of paste used for printing lamination and also coatings of sheet used for sheet lamination. Further, in order to make the powder particle size smaller, a long-time pulverization by a pulverizing device such as a ball mill is required. However, as a result of the long-time pulverization, contaminations are generated from a ball mill and a pulverization container, and a composition deviation of ferrite powders is caused. With this, property deterioration might be caused. Further, when the average particle size is too large, the sinterability decreases, and thereby co-firing with internal electrodes including Ag becomes difficult.

Further, the average particle size of the ferrite powder can be measured by a laser diffraction particle size analyzer (HELOS SYSTEM made by JEOL Ltd.), after putting magnetic ferrite powders in pure water and then dispersing them by a ultrasonic instrument.

The non-magnetic materials include at least oxides of Zn, Cu and Si in a main component. For the main component of the non-magnetic materials, composite oxide, which is expressed by a formula "a(bZnO.cMgO.dCuO).SiO2", is exemplified. In this formula, a is preferably 1.5 to 2.4, more preferably 1.8 to 2.2. Further, b is preferably 0.2 to 0.98, more preferably 0.95 to 0.98. In addition, d is preferably 0.02 to 0.15, more preferably 0.02 to 0.05. c is 1.00−b−d.

As borosilicate glass of subcomponents for the non-magnetic materials, for example, MO—$SiO_2$—$B_2O_3$ glass (MO denotes alkaline earth metal oxide) is exemplified. In borosilicate glass, ZnO, $Al_2O_3$, $K_2O$, $Na_2O$ and the like may be included as other components.

For the properties required for the borosilicate glass as a subcomponent of the non-magnetic materials according to the present embodiment, linear expansion coefficient, glass transition point Tg and the like are exemplified. In the present embodiment, the linear expansion coefficient required for the borosilicate glass is preferably $7.5\times10^{-6}$ to $8.5\times10^{-6}$, and the glass transition point Tg is preferably 600 to 700.

For the borosilicate glass as a subcomponent of the non-magnetic materials according to the present embodiment, with respect to 100 wt % of the whole non-magnetic materials, it is included preferably 0.5 to 17.0 wt %, more preferably 2.0 to 6.0 wt %. When the additive amount of the glass is too small, the sinterability decreases and it becomes difficult to fire below 900° C. Precisely, without the borosilicate glass, it is difficult to fire low dielectric constant non-magnetic material below 900° C.

Further, the appropriate content range of the borosilicate glass changes according to the mixing ratio of the magnetic materials. For example, when the mixing ratio of the magnetic materials is higher with respect to the non-magnetic materials, the content of the borosilicate glass is preferably in the relatively higher range. Further, when the mixing ratio of the magnetic materials is lower with respect to the non-magnetic materials, the content of the borosilicate glass is preferably in the relatively lower range.

As an example of the non-magnetic materials having a composition mainly composed of Zn oxide which does not include glasses, a willemite [(it is also called zinc silicate): $Zn_2SiO_4$] is exemplified. Willemite alone is fired at temperature of 1300° C. or higher. Therefore, by using the MO—$SiO_2$—$B_2O_3$ based glass as sintering auxiliary material, it enables to fire the willemite alone at a firing temperature 900° C. This effect can be maintained even if combined with the magnetic materials.

When the additive amount of borosilicate glass is too large, the permeability tends to decrease and favorable impedance cannot be obtained. As a reason for this, it is considered a reduction of the magnetic domain wall displacement area of the Ni—Cu—Zn based ferrite and a division of the magnetic path. By the intrusion of the MO—$SiO_2$—$B_2O_3$ based glass having a high fluidity into the Ni—Cu—Zn based ferrite grain boundary, a magnetic path of the Ni—Cu—Zn based ferrite is divided. Further, as a result of inhibition of grain growth of the Ni—Cu—Zn based ferrite, the magnetic domain wall displacement area is reduced.

The average particle size of main components of the non-magnetic materials and the average particle size of the borosilicate glass as a subcomponent are not particularly limited. However, the average particle size of the main component is preferably 0.2 to 0.6 μm, and the average particle size of the borosilicate glass is preferably 0.3 to 0.7 μm. For a measuring method of the average particle size, it is the same with the case of ferrite powder.

A multilayer chip coil 1 illustrated in FIG. 1 can be produced by a general production method. Specifically, the composite ferrite composition of the present invention is mixed with a binder and a solvent, and the composite ferrite paste thereby obtained and internal electrode paste containing Ag are alternately printed and laminated and then fired to obtain a chip body 4 (printing method). Or, a green sheet may be produced by using the composite ferrite paste and the internal electrode paste is printed and laminated on the surface of the green sheet and then fired to obtain a chip body 4 (sheet method). In either case, after forming a chip body, a terminal electrodes 5 need to be formed by burning or plating.

The content of the binder and the solvent in the composite ferrite paste is not limited. For example, the content of the binder can be determined in the range of 1 to 10 wt %, and the content of the solvent can be determined in the range of 10 to 50 wt %. Further, in the paste, dispersing agent, plasticizing agent, dielectric material, insulating material and the like may be included in the range of 10 wt % or less, as necessary. For the internal electrode paste containing Ag, it can be produced in the same way. Further, although the firing condition is not particularly limited, the firing temperature is preferably 930° C. or less, more preferably 900° C. or less in case that Ag and the like are included in the internal electrode layers.

Note that the present invention is not limited to the above-mentioned embodiments and capable of various modifications within the scope of the present invention.

Figure 2:
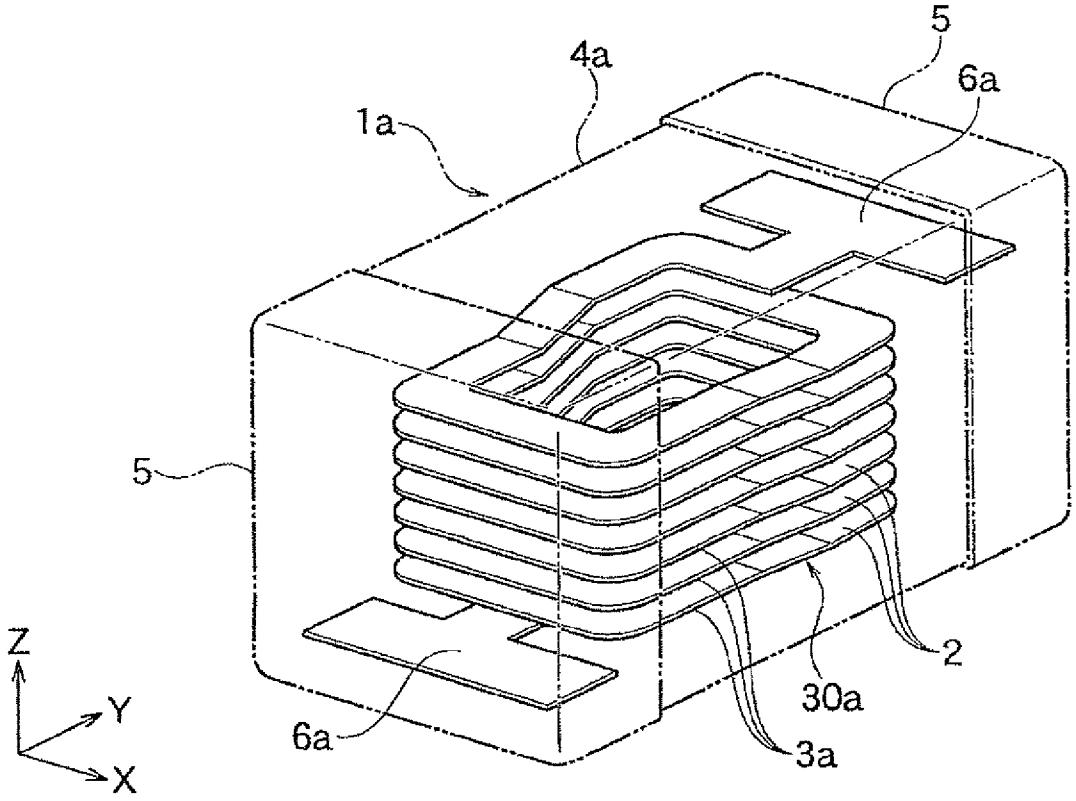
FIG. 2 is an internal schematic perspective view of a multilayer chip coil as an electronic device according to another embodiment.

For example, a ceramic layer 2 of the multilayer chip coil 1*a* illustrated in FIG. 2 may be formed by using the composite ferrite composition of the above-mentioned embodiments. The multilayer chip coil 1*a* illustrated in FIG. 2 comprises a chip body 4*a* wherein ceramic layers 2 and internal electrode layers 3*a* are alternately laminated in the z-axis direction.

Each of internal electrode layers 3*a* has a rectangular annular shape, C shape, or U shape and they are spirally connected by through-hole electrodes (not shown in FIGS) for connecting internal electrodes that penetrating adjacent ceramic layers 2 or stepped electrodes to form a coil conductor 30*a*.

At both ends of the Y-axis direction of the chip body 4*a*, terminal electrodes 5, 5 are respectively formed. At each terminal electrode 5, ends of extraction electrode 6*a* locating on a top and a bottom of the z-axis direction is connected, and each terminal electrode 5, 5 are connected to both ends of the coil conductor 30*a* forming a closed magnetic circuit coil (winding pattern).

In the present embodiment, a laminating direction of the ceramic layer 2 and the internal electrode layer 3 corresponds to the Z-axis, and end surfaces of the terminal electrodes 5, 5 are parallel to the X-axis and the Z-axis. X-axis, Y-axis and Z-axis are mutually perpendicular to one another. In the multilayer chip coil 1*a* illustrated in FIG. 2, a winding axis of the coil conductor 30*a* approximately corresponds to the Z-axis.

Compared with the multilayer chip coil 1*a* illustrated in FIG. 2, for the multilayer chip coil 1 illustrated in FIG. 1, the winding axis of the coil conductor 30 is in the Y-axis direction which is a longitudinal direction of the chip body 4, so that the number of turns can be increased and higher impedance up to higher frequencies is likely to be achieved. For the multilayer chip coil 1*a* illustrated in FIG. 2, other structures and function effects are the same with the multilayer chip coil 1 illustrate in FIG. 1.

Furthermore, the composite ferrite composition of the present invention can be used in ceramic layers which are laminated together with a coil conductor for electronic devices other than chip inductors illustrated in FIG. 1 or 2.

The followings are further detailed explanations of the present invention based on examples. Note that the present invention is not limited to the following examples.

Example 1

First, as a magnetic material, Ni—Cu—Zn based ferrite (average particle size is 0.3 μm), that μ becomes 110 and ∈ becomes 14.0 when filing it alone at 900° C., was prepared.

Next, a non-magnetic material, that μ becomes 1 and ∈ becomes 6 when firing it alone at 900° C., was prepared. The non-magnetic material was prepared by mixing 2(0.98Zn.0.02CuO).$SiO_2$ (average particle size is 0.5 μm) as a main component with SrO—$SiO_2$—$B_2O_3$ based glass (average particle size is 0.5 μm) as a subcomponent so that the content of SrO—$SiO_2$—$B_2O_3$ based glass becomes 3.8 wt % with respect to 100 wt % of the non-magnetic material. Further, as SrO—$SiO_2$—$B_2O_3$ based glass, commercially available one was used.

Further, the above magnetic materials and the non-magnetic materials are respectively weighed so that the mixing ratio of them becomes as indicated in Table 1. After that, the mixture was wet-blended by a ball mill for 24 hours and the slurry thereby obtained was dried by a drying machine to produce a composite material.

Acrylic resin-based binder was added to the obtained composite material and then prilled. After that, a pressure forming was performed to respectively produce a toroidally-shaped compact (measurements: outer diameter 18 mm×inner diameter 10 mm×height 5 mm) and a disc-shaped compact (measurements: outer diameter 25 mm×thickness 5 mm). These compacts were fired at 900° C. for two hours to obtain a sintered compact (composite ferrite composition). The following evaluation was conducted for the obtained sintered compact.

Evaluation

[Relative Density]

For the obtained sintered compact formed in a disc shape, a density of the sintered compact was calculated from the measure and weight of the sintered compact after firing, and further the density of the sintered compact with respect to a theoretical density was calculated as a relative density. In the present example, it was considered preferable that the relative density is 90% or more. The result is shown in Table 1.

[Permeability]

A copper wire was wound with 10 turns around the obtained sintered compact which was formed in a toroidally shape, and the initial permeability μi was measured by using a LCR meter (product name: 4991A made by Agilent Technologies). A measurement was performed in a condition that a measuring frequency was 10 MHz and a measurement temperature was 20° C. In the present example, it was considered preferable that the permeability is 1.4 or more at 10 MHz. The result is shown in Table 1.

[Resonance Frequency]

A copper wire was wound with 10 turns around the obtained sintered compact which was formed in a toroidally shape, and a resonance frequency (MHz) of the permeability in a room temperature was measured by using a impedance analyzer (product name: 4991A made by Agilent Technologies). In the present example, it was considered preferable that the resonance frequency of the permeability is 50 MHz or more. The result is shown in Table 1.

[Dielectric Constant]

A dielectric constant (no unit) of the obtained sintered compact which was formed in a toroidally shape was calculated by a resonance method (JIS R 1627) with using a network analyzer (8510C made by HEW LETT PACKARD). In the present example, it was considered preferable that the dielectric constant is 11 or less. The result is shown in Table 1.

[Specific Resistance]

In—Ga electrode was applied on both surfaces of the obtained sintered compact which was formed in a disc shape and then a DC resistance value was measured to evaluate a specific resistance ρ (unit: Ωm). This measurement was performed by using a IR meter (4329A made by HEWLETT PACKARD). In the present example, it was considered preferable that the specific resistance is $10^6$ Ω·m or more. The result is shown in Table 1.

TABLE 1

| Sample No. | Mixing Ratio [wt %] Magentic Mateial | Non-Magnetic Material | Relative Density [vol %] | Permeability | Resonance Frequency [MHz] | Dielectric Constant | Specific Resistance [Ω · m] |
|---|---|---|---|---|---|---|---|
| 1 | 100:0 | | 99.83 | 111.92 | 22.70 | 14.02 | 2.9E+07 |
| 2 | 90:10 | | 82.61 | 12.29 | 155.09 | 10.17 | 6.5E+05 |
| 3 | 80:20 | | 91.67 | 8.30 | 205.25 | 10.30 | 5.3E+06 |
| 4 | 70:30 | | 93.95 | 5.89 | 222.36 | 9.73 | 1.8E+07 |
| 5 | 60:40 | | 95.07 | 4.41 | 213.63 | 8.98 | 3.7E+09 |
| 6 | 50:50 | | 96.25 | 3.50 | 205.25 | 8.54 | 3.0E+08 |
| 7 | 40:60 | | 97.00 | 2.81 | 213.63 | 7.99 | 2.5E+08 |
| 8 | 30:70 | | 98.71 | 2.12 | 222.36 | 7.60 | 1.8E+08 |
| 9 | 20:80 | | 99.58 | 1.64 | 240.81 | 7.14 | 1.0E+09 |
| 10 | 10:90 | | 100.00 | 1.21 | — | 6.59 | 5.9E+12 |
| 11 | 0:100 | | 98.63 | 1.00 | — | 5.92 | 2.9E+12 |

As shown in Table 1, for the composite ferrite composition that the magnetic materials and the non-magnetic materials were within the range of the present invention, it could be confirmed that all evaluations regarding relative density, permeability, resonance frequency, dielectric constant and specific resistance exhibited favorable results (samples 3 to 9).

On the other hand, for the composite ferrite composition that the magnetic materials and the non-magnetic materials were outside the range of the present invention, it could be confirmed that any one or more of relative density, permeability, resonance frequency, dielectric constant and specific resistance exhibited poor results (samples 1, 2, 10 and 11).

Further, for samples 10 and 11, the resonance frequencies are not shown. It is because the resonant peaks of the permeability could not be observed.

Example 2

Except that the main component composition of the non-magnetic material was changed as shown in Table 2, a sintered compact (composite ferrite composition) was produced and evaluated in the same way with sample 7 of example 1.

As shown in Table 2, for the composite ferrite composition that the main component of the non-magnetic material satisfies the predetermined composition, it could be confirmed that all evaluation items of relative density, permeability, resonance frequency, dielectric constant and specific resistance exhibited a favorable result (samples 12 to 15, 18 to 20, and 23 to 26).

On the other hand, for the composite ferrite composition that the main component of the non-magnetic material does not satisfy the predetermined composition, either one of relative density and specific resistance exhibited a poor result (samples 16, 17, 21, 22 and 27).

Example 3

Except that the amount of glass which is a subcomponent of the non-magnetic material was changed as shown in Table 3, a sintered compact (a composite ferrite composition) was produced and evaluated in the same way with sample 9 of example 1. The result is shown in Table 3.

TABLE 2

| Sample No. | General Formula $a(b\mathrm{ZnO}\bullet c\mathrm{MgO}\bullet d\mathrm{CuO})\bullet \mathrm{SiO_2}$ a | b | c | d | Relative Density [vol %] | Permeability | Resonance Frequency [MHz] | Dielectric Constant | Specific Resistance [Ω · m] |
|---|---|---|---|---|---|---|---|---|---|
| 7 | 2.00 | 0.98 | 0.00 | 0.02 | 97.00 | 2.81 | 213.63 | 7.99 | 2.5E+08 |
| 12 | 2.00 | 0.78 | 0.18 | 0.04 | 96.12 | 2.70 | 213.63 | 7.83 | 1.2E+08 |
| 13 | 2.00 | 0.59 | 0.36 | 0.05 | 95.91 | 3.09 | 143.16 | 8.07 | 3.7E+07 |
| 14 | 2.00 | 0.39 | 0.54 | 0.07 | 96.02 | 3.28 | 99.67 | 8.43 | 3.2E+08 |
| 15 | 2.00 | 0.20 | 0.72 | 0.08 | 91.04 | 3.56 | 54.77 | 8.51 | 1.8E+09 |
| 16 | 2.00 | 0.00 | 0.90 | 0.10 | 73.00 | 2.10 | 231.44 | 5.29 | 1.6E+07 |
| 17 | 2.00 | 1.00 | 0.00 | 0.00 | 83.15 | 1.80 | 240.81 | 6.82 | 8.7E+07 |
| 7 | 2.00 | 0.98 | 0.00 | 0.02 | 97.00 | 2.81 | 213.63 | 7.99 | 2.5E+08 |
| 18 | 2.00 | 0.96 | 0.00 | 0.04 | 97.96 | 3.02 | 213.63 | 8.13 | 1.1E+08 |
| 19 | 2.00 | 0.90 | 0.00 | 0.10 | 97.23 | 3.14 | 205.25 | 8.05 | 2.3E+07 |
| 20 | 2.00 | 0.85 | 0.00 | 0.15 | 98.52 | 3.35 | 205.25 | 8.31 | 4.6E+06 |
| 21 | 2.00 | 0.82 | 0.00 | 0.18 | 99.14 | 3.53 | 213.63 | 8.42 | 6.3E+05 |
| 22 | 1.40 | 0.98 | 0.00 | 0.02 | 88.35 | 1.53 | 240.81 | 6.51 | 2.3E+07 |
| 23 | 1.50 | 0.98 | 0.00 | 0.02 | 91.67 | 1.97 | 231.44 | 6.84 | 8.8E+07 |
| 24 | 1.80 | 0.98 | 0.00 | 0.02 | 95.48 | 2.25 | 222.36 | 7.27 | 2.3E+08 |
| 7 | 2.00 | 0.98 | 0.00 | 0.02 | 97.00 | 2.81 | 213.63 | 7.99 | 2.5E+08 |
| 25 | 2.20 | 0.98 | 0.00 | 0.02 | 97.42 | 4.13 | 213.63 | 8.25 | 1.3E+08 |
| 26 | 2.40 | 0.98 | 0.00 | 0.02 | 92.86 | 3.92 | 213.63 | 7.82 | 9.2E+07 |
| 27 | 2.50 | 0.98 | 0.00 | 0.02 | 88.92 | 3.26 | 213.63 | 7.18 | 5.3E+07 |

TABLE 3

| Sample No. | Amount of Glass [wt %] | Relative Density [vol %] | Perme-ability | Resonance Frequency [MHz] | Dielectric Constant | Specific Resistance [Ω · m] |
|---|---|---|---|---|---|---|
| 31 | 0.4 | 87.34 | 1.66 | 240.81 | 5.62 | 8.1E+08 |
| 32 | 0.5 | 90.39 | 1.69 | 240.81 | 4.94 | 3.7E+09 |
| 33 | 1.0 | 91.99 | 1.75 | 240.81 | 6.09 | 5.5E+10 |
| 34 | 2.0 | 95.75 | 1.77 | 240.81 | 6.76 | 5.7E+09 |
| 9 | 3.8 | 99.58 | 1.64 | 240.81 | 7.14 | 1.0E+09 |
| 36 | 7.4 | 96.94 | 1.63 | 240.81 | 7.13 | 4.2E+08 |
| 37 | 13.0 | 95.45 | 1.51 | 240.81 | 7.12 | 2.5E+08 |
| 38 | 15.0 | 94.66 | 1.48 | 240.81 | 7.12 | 1.5E+08 |
| 39 | 17.0 | 93.02 | 1.45 | 240.81 | 7.12 | 7.0E+06 |
| 40 | 20.0 | 91.41 | 1.32 | 240.81 | 7.12 | 8.0E+05 |

As shown in Table 3, for the composite ferrite composition that the amount of glass which is a subcomponent of the non-magnetic material was within the range of the present invention, it could be confirmed that all of relative density, permeability, resonance frequency, dielectric constant and specific resistance exhibited a favorable result (samples 32 to 39).

On the other hand, for the composite ferrite composition that the amount of glass which is a subcomponent of the non-magnetic material was outside the range of the present invention, it could be confirmed that either one of relative density and permeability exhibited a poor result (samples 31 and 40).

Example 4

Figure 3:
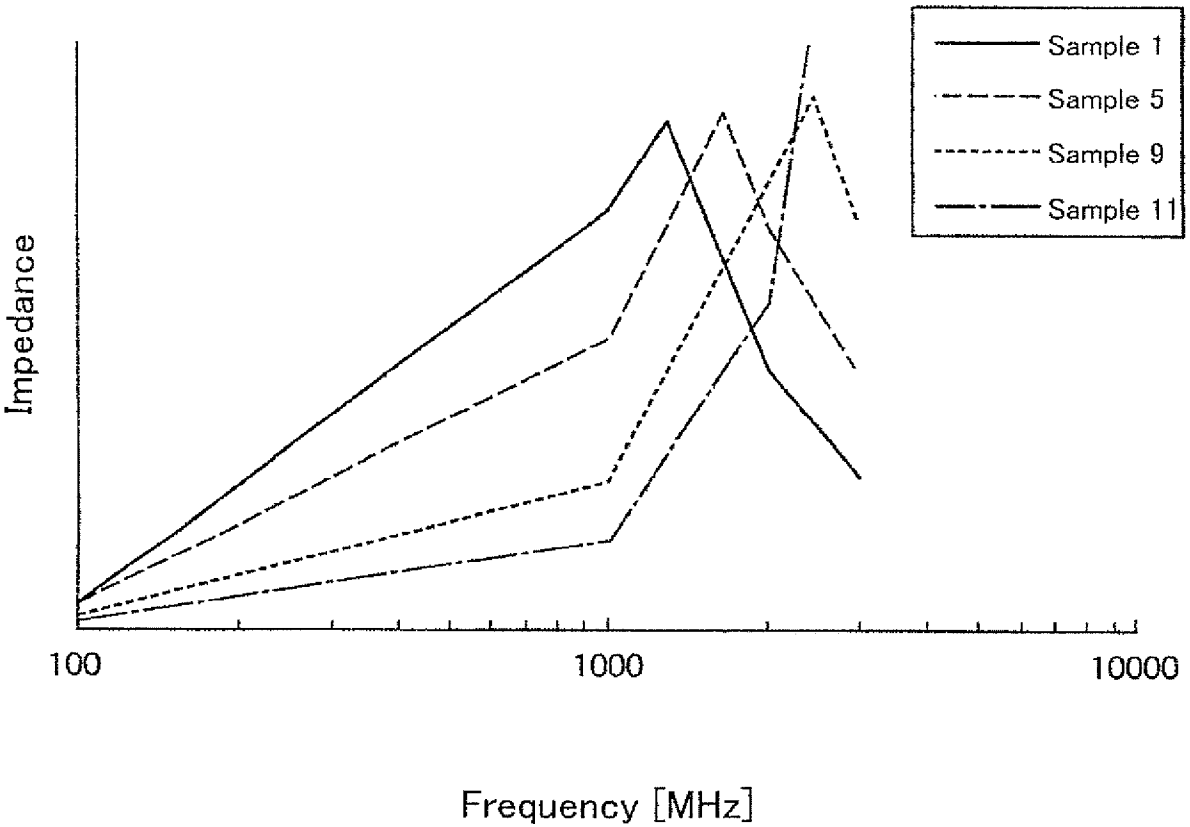
FIG. 3 is a graph showing impedance properties according to examples and comparative examples of the present invention.

By using a composite ferrite composition (samples 1, 5, 9, 11), a multilayer chip coils having a structure shown in FIG. 1 was produced and impedance properties were evaluated. The results are shown in FIG. 3. For a measurement of an exterior appearance of the produced multilayer chip coil, X-axis is 0.5 mm, Y-axis is 1.0 mm and the Z-axis is 0.5 mm.

As shown in FIG. 3, for the composite ferrite composition that the magnetic material and the non-magnetic material were within the range of the present invention, it could be confirmed that high impedance properties can be obtained at GHz bands (samples 5 and 9).

On the other hand, for the composite ferrite composition that the magnetic material and the non-magnetic material are outside the range of the present invention, it could be confirmed that impedance became low at a desired frequency range (GHz) (samples 1 and 11).

Example 5

Except that CaO—$SiO_2$—$B_2O_3$ based glass, BaO—$SiO_2$—$B_2O_3$ based glass are used instead of SrO—$SiO_2$—$B_2O_3$ based glass, the composite ferrite composition was produced and evaluated in the same way with Examples 1 to 4. It was confirmed that the same result can be obtained with Examples 1 to 4.

DESCRIPTION OF THE REFERENCE NUMERALS

1, 1*a*—multilayer chip coil
2—ceramic layer
3, 3*a*—internal electrode layer
4, 4*a*—chip body
5—terminal electrode
6—through-hole electrode for connecting terminals
6*a*—extraction electrode
30, 30*a*—coil conductor

The invention claimed is:

1. A composite ferrite composition, comprising:
a magnetic material and a non-magnetic material;
wherein:
a mixing ratio of said magnetic material and said non-magnetic material is 20 wt %:80 wt % to 80 wt %:20 wt %,
said magnetic material is Ni—Cu—Zn based ferrite,
at least oxides of Zn, Cu, and Si are included in a main component of said non-magnetic material,
borosilicate glass is included in a subcomponent of said non-magnetic material,
the main component of said non-magnetic material is expressed by a general formula "a(bZnO.cMgO.dCuO).$SiO_2$", and
a, b, c and d in the general formula satisfies the following:
a=1.5 to 2.4,
b=0.2 to 0.98,
c=1.00−b−d, and
d=0.02 to 0.15.

2. The composite ferrite composition as set forth in claim 1, wherein
said non-magnetic material includes 0.5 to 17.0 wt % of MO—$SiO_2$—$B_2O_3$ glass (MO denotes alkaline earth metal oxides) as a subcomponent.

3. An electronic device, comprising:
a coil conductor and a ceramic layer laminated;
wherein:
said coil conductor includes Ag, and
said ceramic layer is composed of the composite ferrite composition as set forth in claim 1.

4. An electronic device, comprising:
a coil conductor and a ceramic layer laminated;
wherein:
said coil conductor includes Ag, and
said ceramic layer is composed of the composite ferrite composition as set forth in claim 2.

5. A composite electronic device, comprising:
a coil conductor and a ceramic layer laminated;
wherein:
said coil conductor includes Ag, and
said ceramic layer is composed of the composite ferrite composition as set forth in claim 1.

6. A composite electronic device, comprising:
a coil conductor and a ceramic layer laminated;
wherein:
said coil conductor includes Ag, and
said ceramic layer is composed of the composite ferrite composition as set forth in claim 2.

* * * * *